US005113783A

United States Patent [19]

Den Herder

[11] Patent Number: 5,113,783

[45] Date of Patent: May 19, 1992

[54] SUPPORT FOR DINGHY

[76] Inventor: James F. Den Herder, 14364 Woodhaven Ct., Grand Haven, Mich. 49417

[21] Appl. No.: 650,953

[22] Filed: Feb. 5, 1991

[51] Int. Cl.[5] ..... B63B 23/00

[52] U.S. Cl. ..... 114/365; 224/273

[58] Field of Search ..... 114/258, 259, 343, 362, 114/364, 365, 366, 345; 280/419.1, 419.3; 224/273, 325; 296/157

[56] References Cited

U.S. PATENT DOCUMENTS 4,864,951 9/1989 Koepp, Jr. ..... 114/366

5,018,473 5/1991 Foster ..... 114/259

*Primary Examiner*—Jesûs D. Sotelo

*Attorney, Agent, or Firm*—Flynn, Thiel, Boutell & Tanis

[57] ABSTRACT

A boat having a rear transom and a horizontally enlarged platform fixed to the rear transom and projecting rearwardly from an outer rear surface thereof. A dinghy support arrangement is mounted on the platform for supporting an inflatable dinghy adjacent the transom in generally raised relationship above the water. The dinghy support arrangement includes a horizontally and sidewardly spaced pair of enlarged rings for supportingly engaging tapered rear end portions of the inflatable dinghy. Each ring has an opening therethrough for permitting insertion of one of the tapered rear end portions partially therethrough. The pair of rings are fixedly but releasably attached to the swim platform.

23 Claims, 3 Drawing Sheets

SUPPORT FOR DINGHY

FIELD OF THE INVENTION

This invention relates to an arrangement for securing a dinghy to a vehicle and, in particular, to an improved arrangement attachable to a boat for securing an inflatable dinghy to facilitate storage and transport by a boat while maintaining the dinghy out of the water.

BACKGROUND OF THE INVENTION

Many power boats also have a dinghy which is utilized to provide transport when the boat is docked or anchored. A widely utilized type of dinghy employs an inflatable generally U-shaped pontoon which opens rearwardly and has a transom extending between the legs of the pontoon adjacent the rear free ends thereof. This transom is conventionally utilized for mounting a small outboard motor. The rear free ends of the inflatable pontoon have a generally conical configuration. In some instances a dinghy of this type is towed behind the boat, although this creates obvious disadvantages, particularly in bad weather or rough water. Also, this greater restricts the boat speed in order to avoid swamping the dinghy. In other instances the boat is provided with an attaching device which mounts on the deck of the boat adjacent the rear thereof, which attaching device is constructed similar to a boom and utilizes a pulley and cable arrangement for supporting the dinghy in a suspended condition adjacent the rear of the boat. Other arrangements support the dinghy, when being transported, in an upright position (that is, the dinghy is tilted sidewardly into a generally vertical orientation), and such storage requires that the motor be removed prior to storing of the dinghy. These arrangements, however, have proven less than desirable due to the complexities associated with the storing of the dinghy, and the complexities and expense of the attachment structure.

Accordingly, it is an object of this invention to provide and improved attaching structure for permitting securement of a dinghy, particularly attachment thereof to a boat, which attaching structure greatly simplifies the mounting of a dinghy thereon or removal of the dinghy therefrom, which permits the dinghy to be stored and transported on the boat in such manner that the dinghy is totally removed from the water, which does not require any disassembly of the dinghy such as removal of the motor, which is of a simple and compact arrangement so as to not interfere with overall desirable usage of the boat, which can be readily attached to a boat such as to the rear swim platform thereof, and which includes removable supports which can be readily detached and stored when use of the attachment device is not necessary.

In the improved arrangement of the present invention, a boat having a horizontally projecting rear platform (commonly referred to as a swim platform) is provided with dinghy support means mounted on the platform for removably supporting an inflatable dinghy adjacent the boat transom in generally raised relation above the water. In a preferred embodiment, the dinghy support means includes a horizontally and sidewardly spaced pair of elongate engaging members, each being fixedly detached adjacent the front end thereof to the swim platform. The elongate engaging members project rearwardly away from the platform and each terminates adjacent a rear end thereof in an enlarged ring for supportingly engaging the tapered rear end portion of the inflatable dinghy. Each ring has an opening therethrough for permitting insertion of one of the tapered rear end portions partially therethrough, whereby the support rings support the rearward end of the dinghy, with the dinghy being supported forwardly thereof by bearing against the transom of the boat.

Other objects and purposes of the invention will be apparent to persons familiar with structures of this general type upon reading the following specification and inspecting the accompanying drawings.

Figure 1:
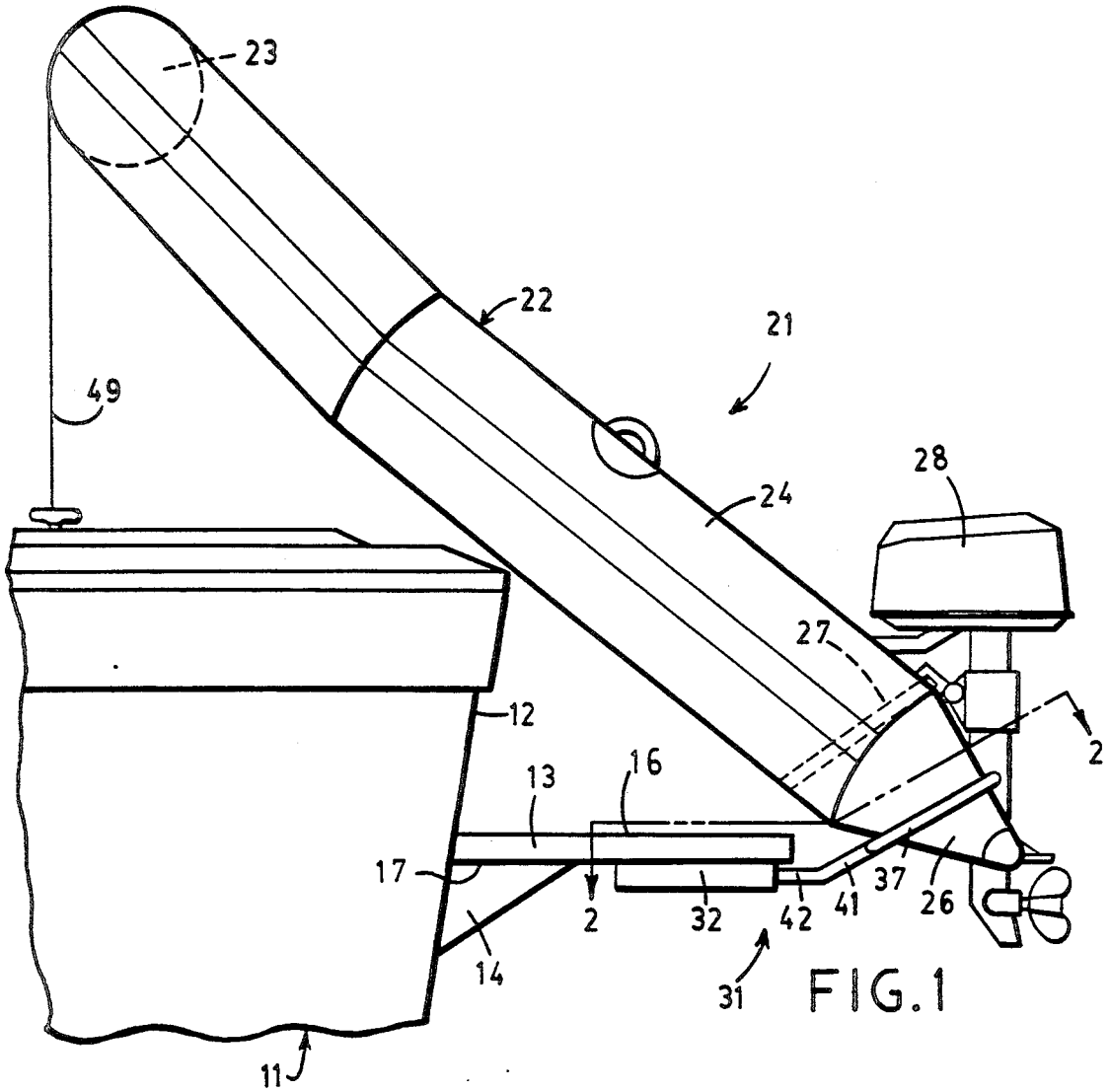
FIG. 1 is a fragmentary side elevational view illustrating attachment of the dinghy to the rear of a boat.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Referring to FIG. 1, there is illustrated the rear portion of a power boat 11 having a rear wall or transom 12. Such power boats are conventionally provided with a horizontally enlarged swim platform 13 projecting rearwardly from and fixed to the transom 12, such as by braces 14. This platform defines thereon top and bottom surfaces 16 and 17, respectively.

FIG. 1 also depicts a conventional dinghy 21 of the type having a generally U-shaped inflatable pontoon 22 which includes a front bight portion 23 joined to a pair of legs or side pontoons 24 which project rearwardly. These inflatable side pontoons 24 terminate in tapered portions 26 at the rear free ends thereof. Such dinghy 21 conventionally has a transom 27 which extends between the side pontoons 24 adjacent the rearward ends thereof, which transom board 27 can be utilized for mounting a small outboard motor 28 thereon.

Figure 2:
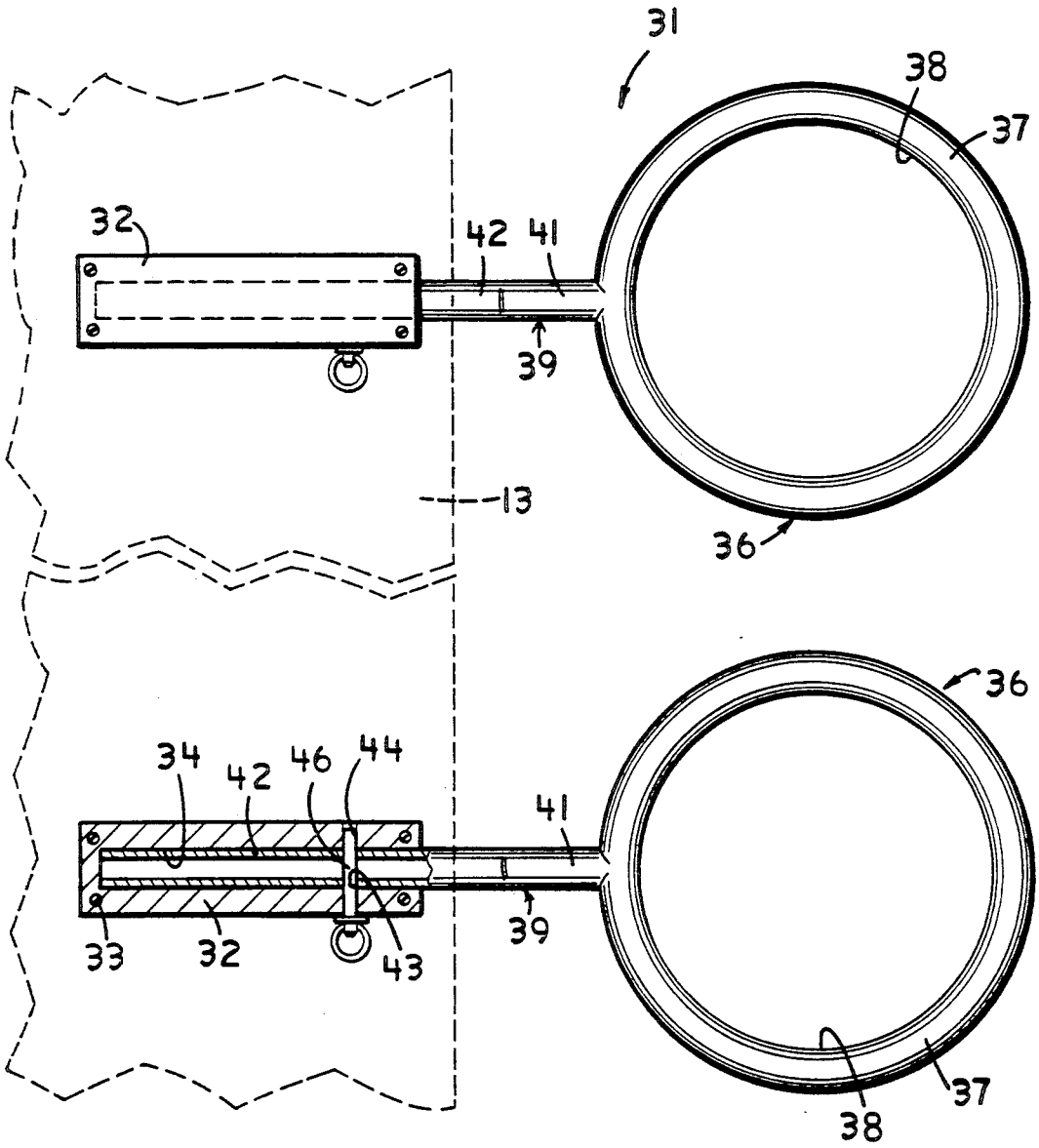
FIG. 2 is an enlarged top view, partially in cross section, taken substantially along line 2—2 in FIG. 1 and illustrating a preferred embodiment of the invention.

To facilitate the securing of the dinghy 21 to the boat 11, while maintaining the dinghy out of the water, the present invention provides an improved securing arrangment 31. This securing arrangement 31, a preferred embodiment of which is illustrated by FIGS. 1 and 2, includes a pair of blocklike attachment members 32 which are fixedly secured to the swim platform 13, preferably to the underside thereof, in generally sidewardly spaced relation by means of fasteners such as screws 33. Each of the attachment members 32 has an elongate generally cylindrical opening 34 opening inwardly from the rearward face thereof, this opening 34 comprising a blind bore. The openings 34 defined by the pair of attachment members 32 extend in generally parallel relationship to one another. Members 32 are typically constructed of a rigid plastics material.

The securing arrangement 31 also includes a pair of dinghy support members 36, each of which is adapted to be releasably attached to a respective one of the attachment members 32.

The dinghy support member 36 includes a generally circular support ring 37 which is continuous and defines a generally circular opening 38 extending axially therethrough. An elongate support arm 39 is fixed to and projects outwardly in generally cantilevered relationship from the support ring 37. This support arm 39 includes an inner arm portion 41 which fixedly attaches to the ring 37 and projects outwardly in generally perpendicular relationship therefrom. This inner arm portion 41 in turn is rigidly joined to an elongate outer arm portion 42 which projects outwardly away from the ring 37 through a greater extent and terminates in a free end. The inner arm portion 41 is disposed within substantially the same plane as the ring 37, whereas the outer arm portion 42 projects at an angle relative to the inner arm portion 41. These arm portions 41 and 42 define an angle therebetween which is greater that 90 degrees but less than 180 degrees, preferably being about 150 degrees, plus or minus about 15 degrees, so that the ring 37 hence angles upwardly relative to the water as is projects rearwardly, substantially as illustrated by FIG. 1.

The outer arm portion 42 is sized so as to be snugly slidably insertable into the opening 34 of the attachment member 32. The arm portion 42 has an opening 43 extending transversely therethrough and alignable with a similar opening 44 which extends transversely through the block 32 in intersecting relationship to the opening 34. When the outer arm portion 42 is inserted into opening 34 so that openings 43 and 44 align as illustrated by FIG. 2, then a locking pin 46 is inserted through the aligned openings to fixedly secure the support member 36 to the respective attachment member 32. This locking pin 46 is conventional and has a spring-urged ball detent associated therewith and a finger loop on one end to facilitate manual handling thereof.

With the support members 36 attached to the attachment members 32 as illustrated by FIGS. 1 and 2, the dinghy 21 is removed from the water and positioned so that the tapered rear end portions 26 of the side pontoons project partially downwardly through the openings 38 of the rings 37. Since these openings 38 (which typically have a diameter of about ten inches) are of lesser diameter than the diameter of the side pontoons 24, this hence results in the tapered end portions 26 becoming seated within the pair of rings 37. This seating within the rings 37, coupled with the upwardly angled relationship of the rings 37, hence enables the dinghy to project forwardly so that the central or front portion of the dinghy contacts and is supported by the boat, such as due to contact with an upper edge portion of the transom 12. The dinghy 21 is preferably additionally secured in any conventional manner, such as by connecting a rope or line 49 between the front of the dinghy and appropriate cleats or other fastening devices provided on the boat.

With the dinghy 21 secured as illustrated by FIG. 1, the dinghy is maintained entirely out of the water, and hence can be readily transported on the boat without interfering with the movement, speed or use of the boat. Further, the dinghy can be stored while maintaining the motor mounted thereon. Thus, the dinghy can be stored and secured in an easy and time-efficient manner, and when use of the dinghy is desired, can be readily removed from the securing arrangement for repositioning in the water.

In addition, the support members 36 can remain attached to the boat without interfering with operation thereof. However, the support members 36 can also be readily detached when desired merely by removing the lock pins 46 and storing the support members 36 on the boat. The lock pins 46 are preferably joined to the attachment members 32 by a flexible tether (not shown) so as to prevent loss thereof.

The dinghy support members 36 of FIGS. 1 and 2 are preferably constructed as rigid one-piece members, and normally are constructed of a hollow cylindrical tube (such as an aluminum or stainless steel tube) to facilitate economical construction while providing a rigid and durable yet lightweight structure.

Figure 5:
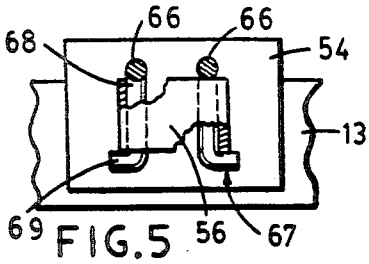
FIG. 5 is a fragmentary enlarged view taken substantially along line 5—5 in FIG. 4.
Figure 3:
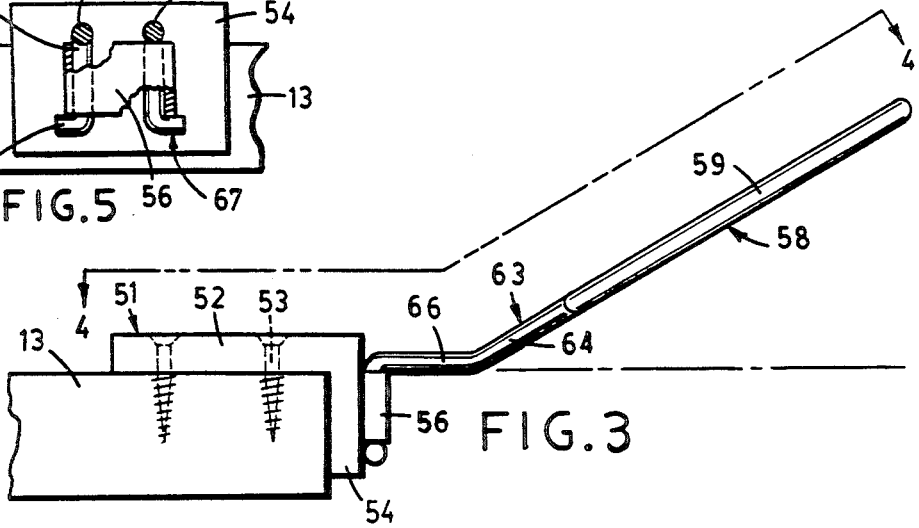
FIG. 3 is a fragmentary side view illustrating a variation of the invention.
Figure 4:
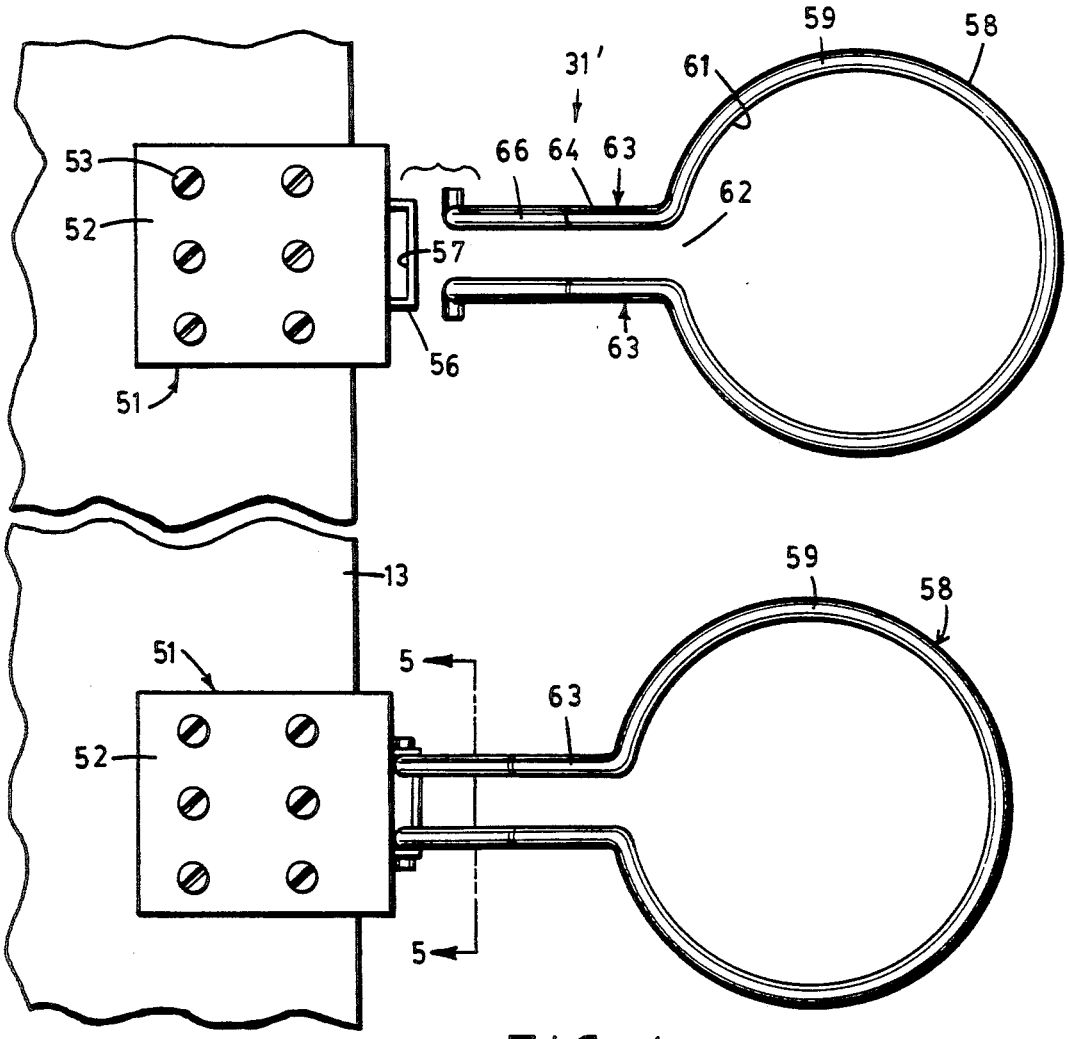
FIG. 4 is a top view, partially in a separated condition, of the embodiment illustrated by FIG. 3.

Referring now to FIGS. 3-5, there is illustrated a variation of the invention. In this variation the dinghy securing arrangement 31' includes a pair of attachment members 51 formed generally as L-shaped brackets which secure to the rear edge of the swim platform 13 by conventional fasteners such as screws 53. The brackets are secured in sidewardly spaced relationship and each has a top leg 52 which overlies the swim platform, and a vertical leg 54 which projects downwardly along the rear vertical edge of the swim platform. A generally U-shaped flange 56 is fixed to and projects rearwardly outwardly from the vertical leg 54. This U-shaped flange 56 defines an opening 57 projecting vertically therethrough in close proximity to the vertical leg 54.

Each attaching bracket 51 cooperates with a dinghy support member 58 which includes a generally circular support ring 59 defining a generally circular opening 61 extending axially therethrough. This support ring 59 has a split 62 formed therein, and the ends of the ring 59 as defined at opposite sides of the split 62 are joined to a pair of support arms 63 which project outwardly in generally parallel relationship away from the ring 59.

Each of the support arms 63 includes an inner arm portion 64 which joins to one of the split ends of the ring 59 and projects perpendicularly outwardly away from the ring in generally the same plane as the ring. This inner arm portion in turn joins to an outer arm portion 66, the latter projecting outwardly away from the ring through a greater extent. These arm portions 64 and 66 intersect at an angle therebetween similar to that of the arm portions 41 and 42 described above relative to FIGS. 1 and 2.

The outer arm portion 66 adjacent the free end thereof has a generally L-shaped latch part fixedly secured thereto. This latch part 67 includes a generally vertical leg portion 68 which joins directly to the free end of the outer arm portion 66 and projects downwardly therefrom in generally perpendicular relationship to the arm portion 66. This vertical leg 68, at the lower end thereof, is fixedly joined to a lower leg (i.e., a latching lug) 69 which projects generally sidewardly through a short extent. That is, this latching lug 69 projects sidewardly in generally perpendicular relationship to both the vertical leg 68 and the outer arm portion 66. The two generally L-shaped latches 67, as defined on the free ends of the pair of arm portions 66, are reversely oriented relative to one another. That is, the pair of latching lugs 69 project outwardly away from one another in opposite directions.

Within the arrangement of FIGS. 3–5, each of the dinghy support members 58 are formed in one piece, such as of steel, and have sufficient resiliency to enable the spaced support arms 63 to be resiliently deflected inwardly toward one another by a sufficient extent to enable the latching parts 67 to be vertically inserted downwardly through the opening 57 until the latching lugs 69 are disposed below the lower edge of the flange 56. By then releasing the inward deflection or compression of the arms 63, the arms 63 resiliently move outwardly away from one another back toward their original configuration, thereby causing the latching lugs 69 to project under the side legs of the flange 56 substantially as illustrated by FIG. 5. When in this latched position shown by FIG. 5, the arms 63 are still preferably slightly inwardly elastically deflected toward one another, and hence the elasticity of the arms and the tendency for the arms to move away from one another thus assists in securely maintaining the latching parts 67 engaged within the opening 57 in the manner illustrated by FIG. 5.

The dinghy securing arrangement 31′ of FIGS. 3–5 is utilized in the same manner as described above relative to FIGS. 1 and 2. Further, the dinghy support members 58 can be readily detached from the brackets 51 and stored on the boat when use thereof is not desired.

Figure 6:
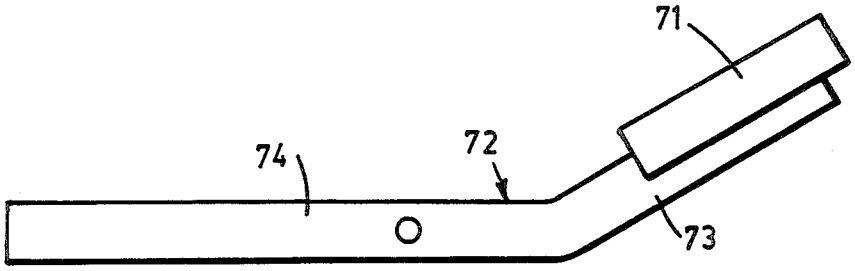
FIGS. 6 and 7 are respectively side and top views of a modified dinghy support for use with the embodiment illustrated by FIGS. 1 and 2.
Figure 7:
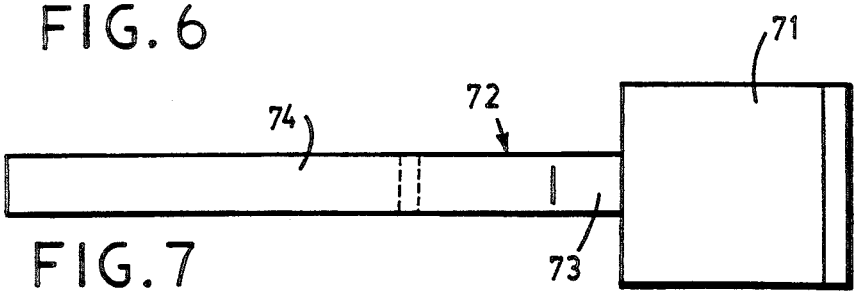

FIGS. 6 and 7 illustrate a variation of a dinghy support member 72 which is designed for use with the attachment members 32. The dinghy support member 72 again includes an elongate arm having portions 73 and 74 which rigidly join together in angled relationship, with the portion 74 being insertable into and fixedly joined to the attachment member 32 in the same manner as illustrated by FIG. 2. In this case, however, the arm portion 73 mounts thereon a dinghy engagement element 71 which is formed substantially as an enlarged pad, which pad can have any desired configuration and can be covered or coated with a protective material such as a rubberlike or plastic material if desired. With this arrangement, when the pair of dinghy supports 72 are mounted in sidewardly spaced relationship so as to project rearwardly of the swim platform, then the pair of sidewardly spaced pads 71 can be utilized to supportingly engage the rear wall or transom of a hard-wall dinghy.

While the invention described and illustrated herein preferably provides a pair of separate but identical attachment members or brackets and a cooperating pair of separate but identical dinghy support members, such being preferred both from an economical manufacturing and shipping and compact storage standpoint, nevertheless it will be recognized that the pair of attachment members and/or the dinghy supports can be rigidly joined as a unitary structure rather than being formed as two separate members. However, constructing the arrangement utilizing a pair of separate but identical attachment members or brackets and a cooperating pair of separate but identical dinghy support elements is desirable and preferred so as to provide for more economical manufacture, efficiency in handling and shipping, and compactness for storage.

While the invention is particularly adapted for use on a boat, it will be appreciated that it could also be mounted on an automotive vehicle such as a truck or van to facilitate handling and transport of an inflatable dinghy.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a boat having a rear transom and a horizontally enlarged platform fixed to said rear transom and projecting rearwardly from an outer rear surface thereof, the improvement comprising dinghy support means mounted on said platform for supporting an inflatable dinghy adjacent said transom in generally raised relationship above the water, said dinghy support means including a horizontally and sidewardly spaced pair of enlarged ring means for supportingly engaging tapered rear end portions of the inflatable dinghy, each said ring means having an opening therethrough for permitting insertion of one of the tapered rear end portions partially therethrough, and means for fixedly attaching said pair of ring means to said platform.

2. A boat according to claim 1, wherein the dinghy support means includes a horizontally and sidewardly spaced pair of elongate dinghy engaging members each being fixedly attached adjacent a front end thereof to said platform, said elongate dinghy engaging members projecting rearwardly away from said platform and each terminating adjacent a rear end thereof in one of said enlarged ring means.

3. A boat according to claim 2, including attachment means fixedly mounted on said platform and cooperating with said dinghy engaging members for fixedly but releasably attaching said dinghy engaging members to said platform.

4. A boat according to claim 3, wherein said attachment means includes a pair of attachment members attached to said platform in sidewardly spaced relationship and each having an opening therein for releasably receiving a forward end portion of a respective said elongate dinghy engaging member.

5. A boat according to claim 4, wherein said attachment member has a rearwardly opening elongate bore formed therein, and the forward end portion of said dinghy engaging member being an elongate portion which is slidably insertable into said bore, and a manually removable locking element movably supported on said attachment member and extending transversely into said bore for engagement with said elongate portion to fixedly but releasably secure said elongate portion to said attachment member.

6. A boat according to claim 4, wherein said dinghy engaging member comprises a one-piece member having a pair of sidewardly spaced elongate arms which at front ends thereof are provided with latching parts which are insertable through said opening, said ring means being fixedly joined to rear ends of said arms, said arms being relatively resiliently deflectable to permit insertion of said latching parts through said opening.

7. A boat according to claim 6, wherein said ring means comprises a loop which is split and terminates at end portions which are rigidly joined to said pair of arms.

8. A boat according to claim 2, wherein said dinghy engaging member comprises a one-piece member having a single elongate arm terminating at a front free end and rigidly joined to said ring means at a rear end thereof, said ring means being a substantially closed loop.

9. A boat according to claim 8, wherein said ring means slopes upwardly as it projects rearwardly so that the opening thereof opens upwardly and forwardly to facilitate insertion of the tapered end portion of the dinghy therein.

10. In a dinghy support means mountable on a boat for supporting an inflatable dinghy having a pair of inflatable side pontoons which terminate in tapered portions at rear free end thereof, the improvement wherein said dinghy support means comprises a pair of dinghy-engaging support ring means for supportingly engaging the tapered portions of said inflatable dinghy, each said support ring means having a through opening for permitting partial insertion of said tapered portion therethrough, said pair of ring means being disposed in sidewardly spaced relationship with the openings thereof being in substantially the same plane, and attachment means for fixedly securing said pair of ring means to a boat in spaced relation from adjacent surfaces of the boat.

11. A dinghy support means according to claim 10, wherein said attachment means is fixed to said boat, and said ring means is releasably coupled to said attachment means.

12. A dinghy support means according to claim 11, including a swim platform fixedly attached to and projecting rearwardly from a rear transom of the boat, said attachment means being mounted on said swim platform, and said ring means being positioned in rearwardly spaced relationship from said platform.

13. A dinghy support means according to claim 10, wherein each said ring means comprises a one-piece member having an elongate arm portion which at one end thereof is fixedly joined to an enlarged ring portion.

14. A dinghy support means according to claim 13, wherein said ring portion defines a closed loop.

15. A dinghy support means according to claim 13, wherein said ring portion is split so as to extend through an angle slightly less than 360 degrees, and said arm portion includes a pair of adjacent arm members which fixedly join to said ring portion adjacent opposite sides of said split.

16. A dinghy support means according to claim 10, wherein said pair of ring means are fixedly attached to but spaced horizontally rearwardly from a rear transom of the boat, and said ring means being oriented so that the openings thereof face upwardly and forwardly to facilitate insertion of the tapered portions of the dinghy therein.

17. A dinghy support means according to claim 10, wherein said attachment means includes a first part fixed to the boat, and a second part fixed to the ring means and projecting outwardly from the respective through opening, said second part being releasably coupled to said first part.

18. A dinghy support means according to claim 10, wherein each said ring means is formed as a separate one-piece member and includes an enlarged ring defining an opening extending therethrough and an arm fixedly attached to said ring and projecting generally radially outwardly therefrom in cantilevered relation and terminating in an attachment portion which is adapted to be fixedly attached to the boat by said attachment means.

19. A dinghy support means according to claim 18, wherein said ring slopes upwardly as it projects rearwardly when mounted on the boat so that the opening thereof opens upwardly and forwardly to facilitate insertion of the tapered end portion of the dinghy therein.

20. In a vehicle having a dinghy support means mounted thereon for supporting a dinghy, the improvement wherein said dinghy support means comprises a pair of dinghy-engaging support members for supportingly engaging rear portions of the dinghy, each support member comprising an enlarged ring defining an opening therethrough for permitting insertion of one of the conical rear end portions of the inflatable dinghy, said pair of support members being disposed in sidewardly spaced relationship, and attachment means for fixedly but releasably securing said pair of support members to said vehicle in spaced relation from adjacent surfaces of said vehicle.

21. A support device for an inflatable dinghy having inflatable side pontoons provided with substantially conical rear end portions, said support device comprising a pair of substantially identical enlarged rings each defining a large diameter opening extending therethrough, each support ring having an arm fixedly attached thereto and projecting outwardly away from the ring so as to not interfere with insertion of the conical rear end portion into the opening, and attachment means joined to the arms of said pair of rings for fixedly joining the rings in a predetermined sidewardly spaced relationship with respect to one another.

22. A support device according to claim 21, wherein said attachment means includes a pair of attachment members each having means which cooperate with the arm of one of said rings for creating a fixed but releasable attachment therebetween.

23. A support device according to claim 21, wherein each said ring and its respective arm is formed as a separate one-piece member with said arm projecting generally radially outwardly in cantilevered relation away from the respective ring and terminating in a free end portion which is fixedly but releasably attached by said attachment means.

* * * * *